US010734774B2

(12) United States Patent
Wang et al.

(10) Patent No.: US 10,734,774 B2
(45) Date of Patent: Aug. 4, 2020

(54) WIRING HARNESS DEVICE AND DISPLAY DEVICE

(71) Applicant: BOE TECHNOLOGY GROUP CO., LTD., Beijing (CN)

(72) Inventors: Zifeng Wang, Beijing (CN); Changlin Leng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/190,844

(22) Filed: Nov. 14, 2018

(65) Prior Publication Data

US 2019/0326717 A1 Oct. 24, 2019

(30) Foreign Application Priority Data

Apr. 23, 2018 (CN) ..... 2018 1 0368288

(51) Int. Cl.
*H01R 35/02* (2006.01)
*B65H 75/44* (2006.01)
*B65H 75/48* (2006.01)

(52) U.S. Cl.
CPC ..... *H01R 35/025* (2013.01); *B65H 75/4471* (2013.01); *B65H 75/486* (2013.01); *B65H 2701/34* (2013.01)

(58) Field of Classification Search
CPC ..... H01R 35/00; H01R 35/02; H01R 35/025; B65H 75/4428; B65H 75/4434; B65H 75/4471; B65H 75/486; B65H 2701/34
See application file for complete search history.

(56) References Cited

U.S. PATENT DOCUMENTS 4,378,473 A * 3/1983 Noorigian ..... H02G 11/02 191/12.2 R
6,287,141 B1 9/2001 Hsieh Huang
6,803,525 B1 * 10/2004 Liao ..... H02G 11/02 174/117 F
7,328,868 B2 * 2/2008 Liao ..... B65H 75/4423 191/12.4
7,900,863 B1 * 3/2011 Cheng ..... B65H 75/4431 242/378.1
10,230,200 B1 * 3/2019 Tomasko ..... H01R 13/72
(Continued)

FOREIGN PATENT DOCUMENTS

CN 202046762 U 11/2011
CN 103700448 A 4/2014
(Continued)

OTHER PUBLICATIONS

First Office Action for CN Appl. No. 20180368288.6, dated Jan. 6, 2020.

*Primary Examiner* — Oscar C Jimenez
(74) *Attorney, Agent, or Firm* — Dinsmore & Shohl LLP

(57) ABSTRACT

The present application provides a wiring harness device a display device. A wiring harness device applied to a wire connected between two interfaces comprises: a wiring harness structure having a first wire inlet and a first wire outlet, the wire entering the wiring harness structure through the first wire inlet and exiting the wiring harness structure through the first outlet, the wiring harness structure configured to store and provide the wire, the wire being controlled to be in a relaxed state upon provision through stretching the wire.

11 Claims, 10 Drawing Sheets

(56) References Cited

U.S. PATENT DOCUMENTS

| | | | | |
|---|---|---|---|---|
| 2005/0098405 | A1* | 5/2005 | Chang | H02G 11/02 191/12.2 R |
| 2005/0178871 | A1* | 8/2005 | Liao | H02G 11/02 242/378.1 |
| 2006/0027433 | A1* | 2/2006 | Wu | B65H 75/4434 191/12.2 R |
| 2006/0138268 | A1* | 6/2006 | Huang | B65H 75/4434 242/378.1 |
| 2007/0170295 | A1* | 7/2007 | Breeden | B60D 1/18 242/388.1 |
| 2009/0014575 | A1* | 1/2009 | Cheng | B65H 75/4434 242/397 |
| 2009/0050099 | A1* | 2/2009 | Chang | B65H 75/4434 123/185.3 |
| 2013/0284843 | A1* | 10/2013 | Mertesdorf | B65H 75/4402 242/397 |
| 2019/0165530 | A1* | 5/2019 | Katsuramaki | B60J 7/0573 |

FOREIGN PATENT DOCUMENTS

| | | | |
|---|---|---|---|
| CN | 204416807 | U | 6/2015 |
| CN | 206697696 | U | 12/2017 |
| CN | 207158510 | U | 3/2018 |

* cited by examiner

WIRING HARNESS DEVICE AND DISPLAY DEVICE

CROSS REFERENCE TO RELATED APPLICATIONS

The present application claims priority to Chinese Patent Application No. 201810368288.6, filed on Apr. 23, 2018, the disclosure of which is hereby incorporated by reference in its entirety.

FIELD

The present disclosure relates to the field of display technology, particularly to a wiring harness device and a display device.

BACKGROUND

With the advancement of technology, in some display scenarios, variable display such as foldable display for flexible display screens, expandable display for LCD (Liquid Crystal Display) etc. has appeared, which can change the size of the display devices depending on the needs of scene for users.

SUMMARY

According to an aspect of the present disclosure, there is provided a wiring harness device applied to a wire connected between two interfaces, comprising: a wiring harness structure having a first wire inlet and a first wire outlet, the wire entering the wiring harness structure through the first wire inlet and exiting the wiring harness structure through the first wire outlet, the wiring harness structure is configured to store and provide the wire, and control the wire to be in a relaxed state after stretching the wire to provide the wiring.

In some embodiments according to the present disclosure, the wiring harness device further comprises: an interface protection structure disposed between the interface and the wiring harness structure, wherein the interface protection structure has a second wire inlet and a second wire outlet, the wire enters the interface protection structure through the second wire inlet and exits the interface protection structure through the second wire outlet, the interface protection structure is configured to limit a stretched length of the wire between the second wire inlet and the second wire outlet.

In some embodiments according to the present disclosure, the interface protection structure comprises: an elastic member having the second wire inlet and an intermediate wire outlet that allow the wire to pass through, wherein the wire is fixedly connected to the elastic member at the positions of the second wire inlet and the intermediate wire outlet, the wire between the second wire inlet and the intermediate wire outlet is in a bent state when the elastic member is in a natural state, and when the elastic member is in a maximum tension state, the wire between the second wire inlet and the intermediate wire outlet is in a straight state; and a limiting member having an intermediate wire inlet and the second wire outlet that allow the wire to pass through, and configured to limit a stretched length of the elastic member.

In some embodiments according to the present disclosure, the wiring harness structure comprises: a first housing, a second housing, a rotating wheel, a first elastic member, a second elastic member, a first button structure, and a second button structure; wherein, the first housing has the first wire inlet and the first wire outlet; the wire is wound on the rotating wheel; the first button structure is disposed on the first housing and configured to control rotation of the rotating wheel in a first direction; the second button structure is disposed on the second housing and connected to the rotating wheel, configured to control rotation of the rotating wheel in a second direction, wherein the second direction is opposite to the first direction; the rotating wheel is disposed between the first housing and the second housing, and is coupled to the second elastic member at a side close to the bottom of the first housing; the rotating wheel is configured to rotate in a second direction when the wire is stretched such that the second elastic member is in a compressed state, and after the stretch of the wire, the rotating wheel continues to rotate in the second direction by an angle under the control of the second button structure and is fixed by the first button structure so that the wire is in a relaxed state; when the wire is stored, the fixing of the rotating wheel is canceled by the first button structure so that the rotating wheel rotates in the first direction by the restoring force of the second elastic member to store the wire.

In some embodiments according to the present disclosure, the rotating wheel comprises a first top structure, a turntable, an isolating cover, an inner structure, and a snap structure; the first top structure is coupled to the second button structure; the first top structure has a plurality of first guiding rods on an outer side surface of the first top structure; a slot is provided on the turntable in its radial direction, the wire being wound between the turntable and the isolating cover, and between the turntable and the first guiding rods through the slot respectively; the inner structure and the snap structure are both located on a side of the isolating cover facing away from the turntable, and a central position of the second elastic member is fixed between the inner structure and the snap structure.

In some embodiments according to the present disclosure, the first housing comprises a first body, an assembly structure, a sleeve structure, and two limiting slots; the sleeve structure and the two limiting slots are fixed on the bottom of the first body, the first elastic member and the inner structure are both disposed in the sleeve structure, and the second elastic member is fixed between the two limiting slots; the first body has the first wire inlet, the first wire outlet, and a button opening for mounting the first button structure, the first button structure being assembled in the assembly structure and protruding from the button opening.

In some embodiments according to the present disclosure, the first wire inlet and the first wire outlet are disposed at different depths of the first body.

In some embodiments according to the present disclosure, the second elastic member is a coil spring, and two ends of the coil spring are fixed in the two limiting slots respectively.

In some embodiments according to the present disclosure, the first button structure comprises a button, a fulcrum, and a limiting portion; the fulcrum is located in the assembly structure, the button protrudes from the button opening, and the limiting portion is located in the first body, wherein one end of the fulcrum is connected to the button, and the other end of the fulcrum is connected to the limiting portion, the limiting portion has a first end; the turntable is provided with a plurality of teeth; the button is configured to act on the fulcrum to move the limiting portion, so that the first end is engaged with the teeth to limit rotation of the rotating wheel in the first direction.

In some embodiments according to the present disclosure, the second housing has a through hole; an inner wall of the through hole is provided with a first guiding groove, a second guiding groove and an inclined portion, the depth of the first guiding groove is greater than the depth of the second guiding groove;

the second button structure comprises a second body and a second top structure, wherein the second body has a plurality of second guiding rods on an outer side surface of the second body, an end of the second body close to the first top structure is connected to the second top structure, and an end surface of the second top structure is beveled; the first top structure is nested within the second body; the second button structure is configured to, when in a pressed state, move the second guiding rod on the second body in a third direction along the first guiding slot and the second guiding slot, push the first top structure to drive the first guiding rod to move in the third direction along the first guiding groove to compress the first elastic member; and when the pressing is canceled, deflect the first guiding rod by the first elastic member in cooperation with the second top structure and the inclined portion, to control the rotating wheel to continue rotating in the second direction.

In some embodiments according to the present disclosure, the first elastic member is a spring.

According to another aspect of the present disclosure, there is provided a display device comprising the wiring harness device as described above.

DETAILED DESCRIPTION OF PREFERRED EMBODIMENTS

In order to make the above objects, features, and advantages of the present disclosure more comprehensible, the present disclosure will be further described in detail with reference to the accompanying drawings and specific embodiments.

In changing a display mode of a display device, the layout relationship between circuit boards in the display device also changes, such as the position of a signal board to a processing board may change. For example, a distance between the signal board and the processing board increases in the case that the display device is stretched, and is shortened in the case that the display device is contracted.

When the display device is contracted, a wire between the two boards is liable to be tangled due to the shortened distance between the two circuit boards.

According to some embodiments of the present disclosure, a wiring harness device and a display device are provided to solve the problem that a wire is liable to be tangled when the display mode of the display device is changed.

Figure 1:
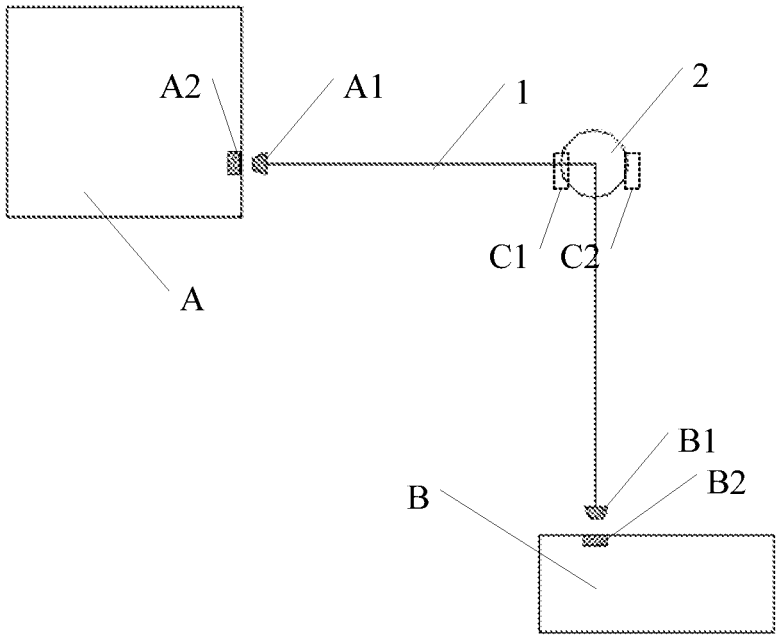
FIG. 1 is a schematic structural view of a wiring harness device according to an embodiment of the present disclosure.

FIG. 1 is a schematic structural view of a wiring harness device according to an embodiment of the present disclosure.

A wiring harness device applied to a wire 1 connected between two interfaces (A1 and B1 in FIG. 1) is provided in an embodiment of the present disclosure. The wiring harness device comprises a wiring harness structure 2. The wiring harness structure 2 has a first wire inlet C1 and a first wire outlet C2. The wire 1 enters the wiring harness structure 2 through the first wire inlet C1 and exits the wiring harness structure 2 through the first wire outlet C2. The wiring harness structure 2 is configured to store and provide the wire 1 between the two interfaces (A1 and B1) and control the wire 1 to be in a relaxed state after stretching the wire 1 to provide the wire 1.

It should be noted that the interface A2 refers to an interface to which the interface A1 of the wire 1 is correspondingly connected and is located in a device A to be connected to the wire 1; the interface B2 refers to an interface to which the interface B1 of the wire 1 is connected and is located in a device B which needs to be connected with the device A through the wire 1.

When the wire 1 is not stretched, an excess portion of the wire is wound in the wiring harness structure 2, and when the wire 1 needs to be stretched, the portion of the wire 1 wound in the wiring harness structure 2 is stretched out to provide a wire of a desired length. After the wire 1 is stretched, the wire 1 is controlled to be in a relaxed state to ensure the service life of the wire; when the excess portion of the wire 1 is not required, it can be drawn back and stored by the wiring harness structure 2, so that the wire will not be tangled.

Figure 2:
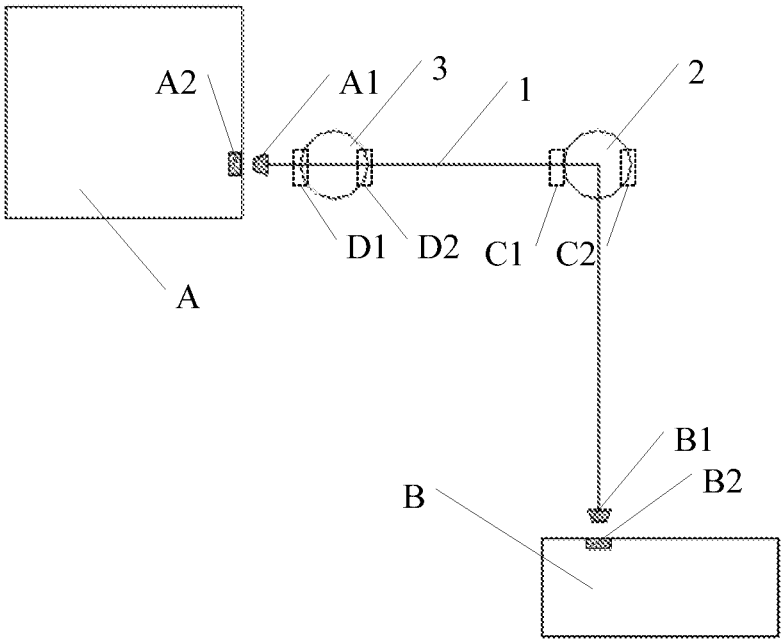
FIG. 2 is a schematic structural view of another wiring harness device according to an embodiment of the present disclosure.

FIG. 2 is a schematic structural view of another wiring harness device according to an embodiment of the present disclosure.

In this embodiment of the present disclosure, the wiring harness device further comprises an interface protection structure 3 having a second wire inlet D1 and a second wire outlet D2. The wire 1 enters the interface protection structure 3 through the second wire inlet D1 and exits the interface protection structure 3 through the second wire outlet D2. The interface protection structure 3 is configured to limit a stretched length of the wire 1 between the second wire inlet D1 and the second wire outlet D2.

When the wire 1 needs to be stretched, the stretched length of the wire 1 between the second wire inlet D1 and the second wire outlet D2 is restricted by the interface protection structure 3, so that the wire 1 between the second wire inlet D1 and the second wire outlet D2 cannot be excessively stretched, preventing the interface of the wire 1 from being disconnected from the correspondingly connected interface due to an excessive stretch of the wire 1, for example, preventing the interface A1 from disconnected from the interface A2.

It should be noted that the interface protection structure 3 can be disposed at a position close to the device A. In this case, the wiring harness structure 2 is disposed between the device B and the interface protection structure 3; the interface protection structure 3 can also be disposed a position close to the device B. In this case, the wiring harness structure 2 is disposed between the device A and the interface protection structure 3. Certainly, it is also possible to dispose interface protection structures 3 at both ends close to the device A and the device B respectively. In this case, the wiring harness structure 2 is disposed between two interface protection structures 3; the specific positional relationship between the interface protection structure 3 and the wiring harness structure 2 is determined according to actual applications, which is not limited in the embodiment of the present disclosure.

Figure 3:
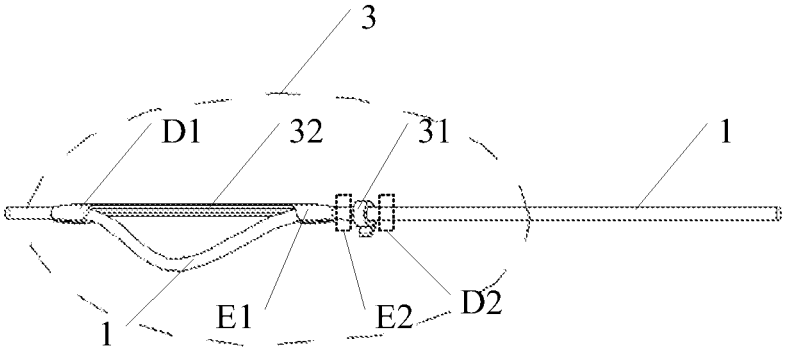
FIG. 3 is a schematic structural diagram of an interface protection structure according to an embodiment of the present disclosure.

FIG. 3 is a schematic structural diagram of an interface protection structure according to an embodiment of the present disclosure.

In this embodiment of the present disclosure, the interface protection structure 3 includes a limiting member 31 and an elastic member 32; the elastic member 32 has a second wire inlet D1 and an intermediate wire outlet E1 that allow the wire 1 to pass through. At the positions of the second wire inlet D1 and the intermediate wire outlet E1, the wire 1 is fixedly connected to the elastic member 32. In a natural state of the elastic member 32 (i.e., in a state where no external force is applied), the wire 1 between the second wire inlet D1 and the intermediate wire outlet E1 is in a bent state. In a maximum tension state of the elastic member 32, the wire 1 between the second wire inlet D1 and the intermediate wire outlet E1 is in a straight state. The limiting member 31 has an intermediate wire inlet E2 and the second wire outlet D2 that allow the wire 1 to pass through. The intermediate wire inlet E2 is close to the intermediate wire outlet E1. The limiting member 31 may be, for example, fixed on the housing of the wiring harness device, and is configured to limit a stretched length of the elastic member 32.

As shown in FIGS. 2 and 3, when the wire 1 is stretched at one side of the limiting member 31 away from the elastic member 32, force is applied to the wire 1 so that the wire 1 between the second wire inlet D1 and the intermediate wire outlet E1 and the elastic member 32 are stretched toward the limiting member 31. In the natural state of the elastic member 32, the wire 1 between the second wire inlet D1 and the intermediate wire outlet E1 is in a bent state, no force is applied to the elastic member 32 when the wire 1 between the second wire inlet D1 and the intermediate wire outlet E1 begins to be stretched, and the limiting member 31 blocks the elastic member 32 before the wire 1 is straightened, thereby the wire 1 between the second wire inlet D1 and the intermediate wire outlet E1 and the elastic member 32 cannot be stretched toward the limiting member 31 any more. At this point, the interface A1 is only subjected to a small elastic force of the elastic member 32, and the force applied on interface A1 is not affected when the wire 1 is continually stretched at one side of the limiting member 31 away from the elastic member 32. When the elastic member 32 is retracted without being subjected to a force, the wire 1 between the second wire inlet D1 and the intermediate wire outlet E1 is also restored to the bent state. In this condition, the interface A1 is not subjected to any stress.

Figure 4:
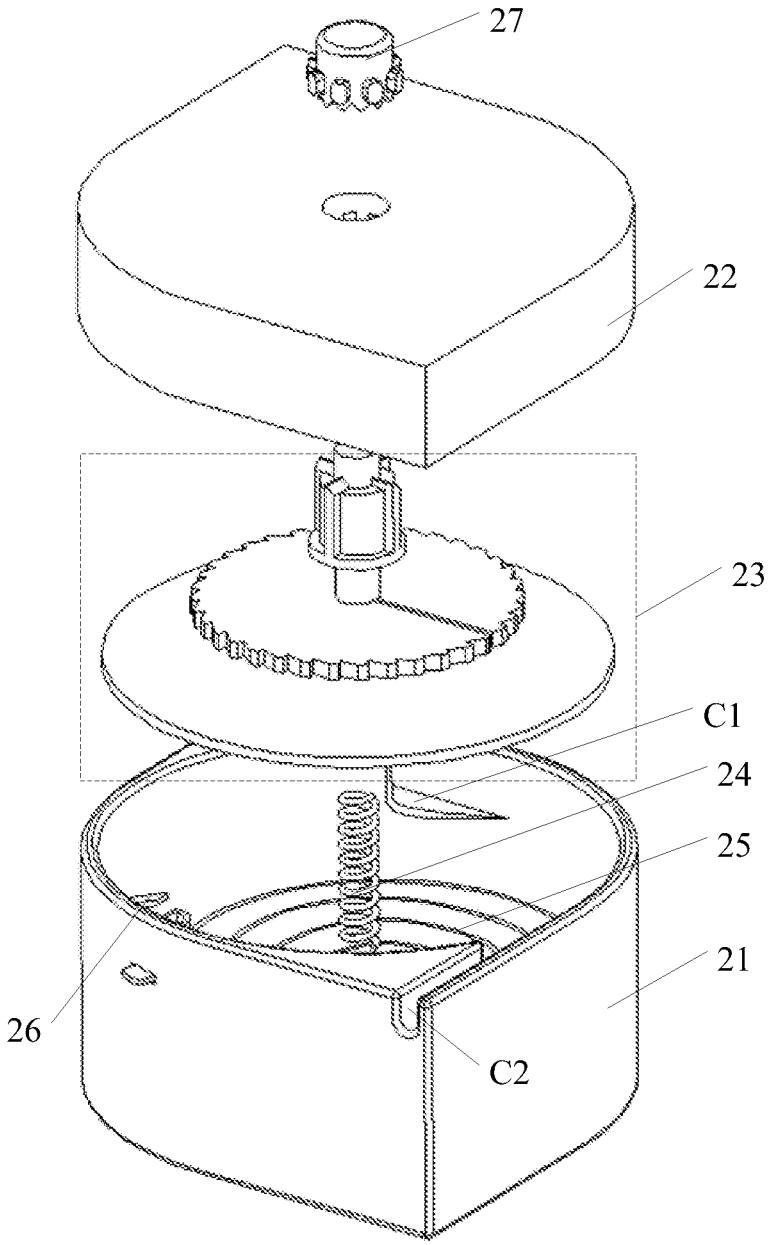
FIG. 4 is a schematic structural view of a wiring harness device according to an embodiment of the present disclosure.

FIG. 4 is a schematic structural view of a wiring harness device according to an embodiment of the present disclosure.

In this embodiment of the present disclosure, the wiring harness structure 2 comprises: a first housing 21, a second housing 22, a rotating wheel 23, a first elastic member 24, a second elastic member 25 a first button structure 26, and a second button structure 27; wherein, the first housing 21 has a first wire inlet C1 and a first wire outlet C2; the wire 1 passing through the first wire inlet C1, winding on the rotating wheel 23, and extending through the first wire outlet C2.

The first button structure 26 is disposed on the first housing 21 and configured to control rotation of the rotating wheel 23 in a first direction. The second button structure 27 is disposed on the second housing 22 and connected to the rotating wheel 23, and is configured to control rotation of the rotating wheel 23 in a second direction which is opposite to the first direction.

The rotating wheel 23 is disposed between the first housing 21 and the second housing 22, and one end of the rotating wheel 23 that is close to the bottom of the first housing 21 is connected to the second elastic member 25. The rotating wheel is configured to rotate in a second direction when the wire 1 is stretched to deform the second elastic member 25 (for example, in a compressed state or a stretched state), and after the stretch of the wire 1, continue rotating in the second direction under the control of the second button structure 27, so that the wire 1 is in a relaxed state (i.e., in a state free from external force). The rotating wheel 23 rotates in the first direction to draw back and store the wire 1 by a restoring force of the second elastic member 25 under the control of the first button structure 26 when the wire 1 is drawn hack.

It should be noted that FIG. 4 only shows a schematic structural view of the various components of the wiring harness structure 2. In practical applications, it is necessary to assemble those components, for example, the second button structure 27 is assembled onto the rotating wheel 23 and then protrudes from the second housing 22.

Since the wire 1 is wound on the rotating wheel 23, when the wire 1 is stretched, the rotating wheel 23 is rotated in the second direction to compress the second elastic member 25; when the wire 1 is no longer stretched, since the resilience effect of the second elastic member 25 is always exerted on the wire 1, at this point, the second button structure 27 is pressed to control the rotating wheel 23 to continue rotating in the second direction by an angle, thereby relaxing the wire 1 so that it is no longer stressed. The wire 1 is in a relaxed state to ensure the service life of the wire 1. Then, the first button structure 26 is toggled to prevent rotation of the rotating wheel 23 in the first direction by the restoring force of the second elastic member 25. At this point, since the wire 1 is in a relaxed state, the elastic member 32 between the second wire inlet D1 and the intermediate wire outlet E1 also retracts, and eventually the wire 1 in the entire wiring harness device is no longer stressed.

When it is required to draw back the wire 1, the first button structure 26 is pressed, the rotating wheel 23 is rotated in the first direction by the restoring force of the second elastic member 25, and the wire 1 is drawn back and re-wound on the rotating wheel 23. After the completion of the entire draw-back process, the wire 1 is unstressed to protect the interface A1 of the wire 1 from being disconnected from the interface A2 due to stress, and protect the interface B1 of the wire 1 from being disconnected from the interface B2 due to stress. During the stretching and draw-back processes of the wire 1, the interfaces A1 and B1 will not loose or fall off from the corresponding interfaces A2 and B2.

It should be noted that in a case where the first direction is the clockwise direction, the second direction is the counterclockwise direction, the rotating wheel 23 rotates in the counterclockwise direction when the wire is stretched, and rotates in the clockwise direction when the wire 1 is drawn back. In a case where the first direction is the counterclockwise direction and the second direction is the clockwise direction, the rotating wheel 23 rotates in the clockwise direction when the wire is stretched, and rotates in the counterclockwise direction when the wire 1 is drawn back. The specific directions of the first direction and the second direction can be determined according to the actual condition of the wiring harness structure 2 and the wire 1.

Figure 5:
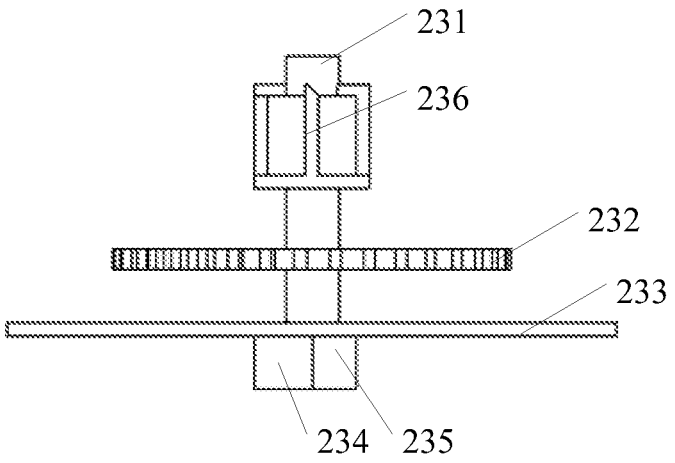
FIG. 5 is a schematic structural view of a rotating wheel according to an embodiment of the present disclosure.
Figure 6:
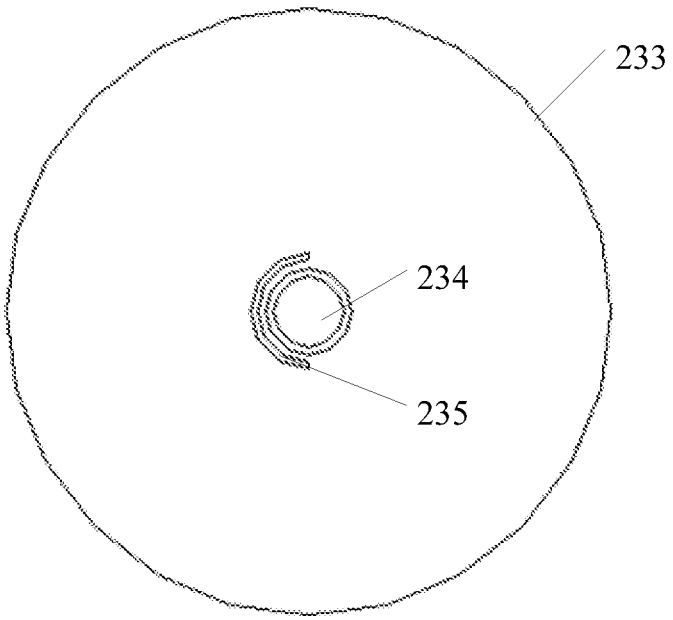
FIG. 6 is a schematic structural view of an inner structure and a snap structure of the rotating wheel according to an embodiment of the present disclosure.
Figure 7:
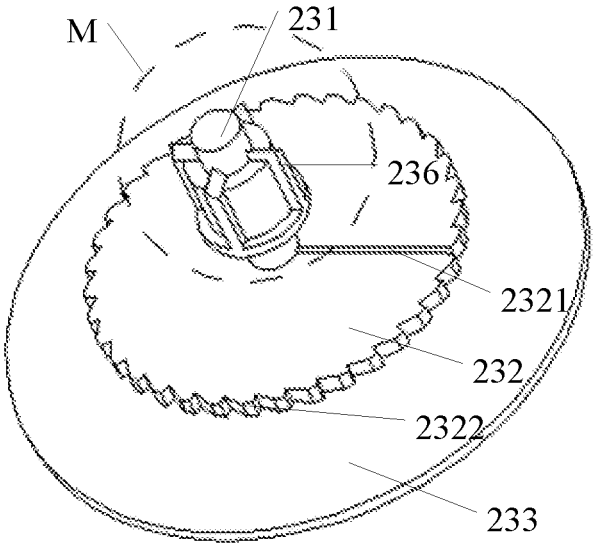
FIG. 7 is a side view of the rotating wheel according to the embodiment of the present disclosure.

FIG. 5 is a schematic structural view of a rotating wheel according to an embodiment of the present disclosure, FIG. 6 is a schematic structural view of an inner structure and a snap structure of the rotating wheel, and FIG. 7 is a side view of the rotating wheel.

In the embodiment of the present disclosure, as shown in FIG. 5 to FIG. 7, the rotating wheel 23 includes a first top structure 231, a turntable 232, an isolating cover 233, an inner structure 234, and a snap structure 235. The first top structure 231 is connected to the second button structure 27; the first top structure 231 has a plurality of first guiding rods 236 on an outer side surface thereof; a slot 2321 is provided on the turntable 232 in its radial direction, the wire 1 being wound between the turntable 232 and the isolating cover 233, and between the turntable 232 and the first guiding rods 236 through the slot 2321 respectively. The inner structure 234 and the snap structure 235 are both located on one side of the isolating cover 233 facing away from the turntable 232, and a central position (portion) of the second elastic member 25 is fixed between the inner structure 234 and the snap structure 235.

By fixing the central position of the second elastic member 25 between the inner structure 234 and the snap structure 235, the second elastic member 25 can be compressed when the rotating wheel is rotated in the second direction.

Wherein, a circular hole is provided at a central position of the turntable 232, the first top structure 231 penetrates the turntable 232 through the circular hole and is fixed on the isolating cover 233; the wire 1 is inserted through the first wire inlet C1 of the first housing 21, and is wound between the turntable 232 and the isolating cover 233; the wire 1 then goes through the slot 2321 on the turntable 232 and is wound between the turntable 232 and the first guiding rods 236, and extends out of the first wire outlet C2 of the first housing 21.

It should be noted that in some embodiments of the present disclosure, the inner structure 234 may be a columnar structure, the snap structure 235 may be a semi-circular protrusion structure, and the rotating wheel 23 may be fixed to the second elastic member 25 by the inner structure 234 and snap structure 235.

Figure 8:
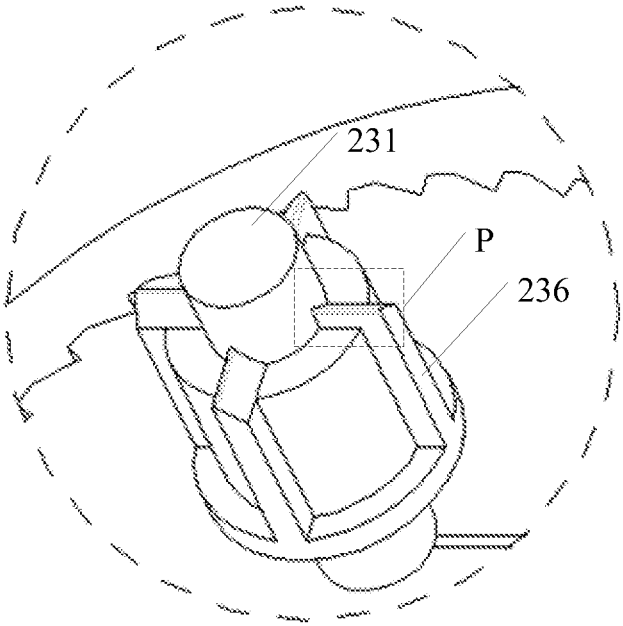
FIG. 8 is a partial enlarged view of region M of the rotating wheel shown in FIG. 7.

FIG. 8 is a partial enlarged view of region M of the rotating wheel shown in FIG. 7.

A plurality of first guiding rods 236 are provided on the outer side surface of the first top structure 231. The top end P of the first guiding rod 236 is beveled, and the top end P refers to an end of the first guiding rod 236 away from the turntable 232.

Figure 9:
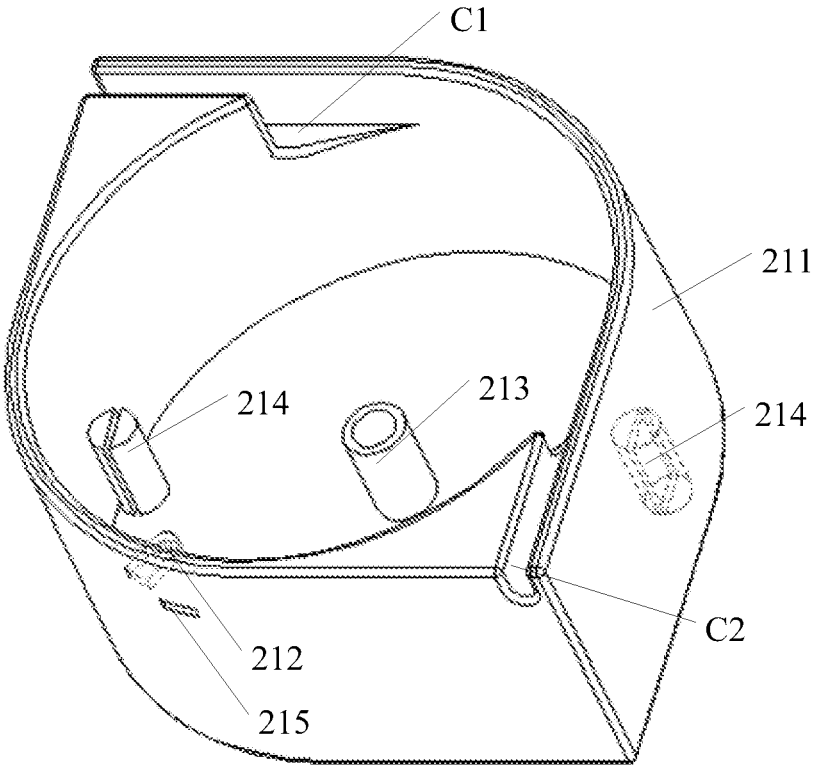
FIG. 9 is a schematic structural view of a first housing according to an embodiment of the present disclosure.

FIG. 9 is a schematic structural view of a first housing according to an embodiment of the present disclosure.

In this embodiment of the present disclosure, the first housing 21 comprises a first body 211, an assembly structure 212, a sleeve structure 213, and two limiting slots 214. The sleeve structure 213 and the two limiting slots 214 are fixed on the bottom of the first body 211, the first elastic member 24 and the inner structure 234 are both disposed within the sleeve structure 213, and the second elastic member 25 is fixed between the two limiting slots 214. The first body 211 has the first wire inlet C1, the first wire outlet C2, and a button opening 215 for mounting the first button structure 26. The first button structure 26 is assembled in the assembly structure 212 and protrudes from the button opening 215.

Wherein, the first wire inlet C1 and the first wire outlet C2 are staggered in the horizontal direction to facilitate the two-layer winding of the wire 1 on the rotating wheel 23, for example, the depth of the first wire inlet C1 can be set to be greater than the depth of the first wire outlet C2. The depth refers to a distance from the upper surface of the first body 211 to the surface of the first wire inlet C1 or the surface of the first wire outlet C2.

It should be noted that the sleeve structure 213 is located at a central position between the two limiting slots 214.

Figure 10:
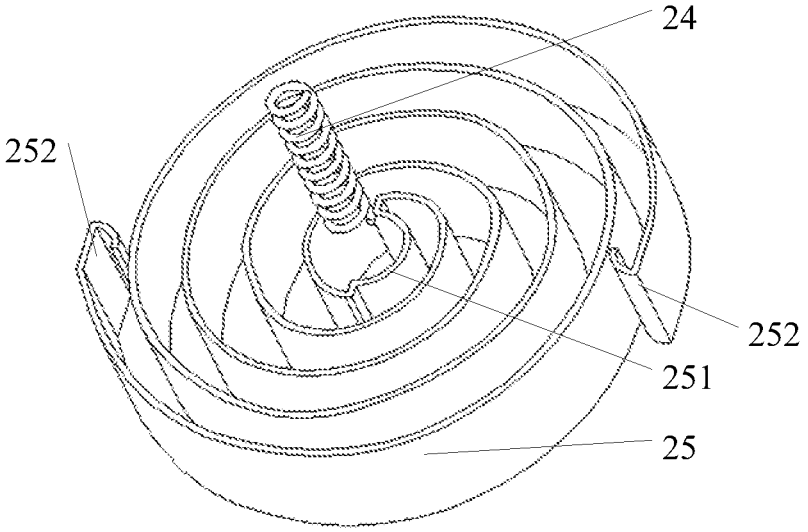
FIG. 10 is a schematic structural view of a first elastic member and a second elastic member according to an embodiment of the present disclosure.

FIG. 10 is a schematic structural view of a first elastic member and a second elastic member according to an embodiment of the present disclosure.

The second elastic member 25 is, for example, a coil spring, two ends of the coil spring being fixed in the two limiting slots 214 respectively.

The coil spring is fixed to the first housing 23 by inserting the two ends 252 of the coil spring into the two limiting slots 214 respectively. In this situation, the central position 251 of the coil spring surrounds the sleeve structure 213.

As shown in FIG. 10, the first elastic member 24 is, for example, a cylindrical spring. As shown in FIGS. 6, 9, 10, the first elastic member 24 is inserted into the sleeve structure 213 of the first housing 21, and the two ends 252 of the second elastic member 25 are fixed to the two limiting slots 214 respectively. The inner structure 234 of the rotating wheel 23 is then placed in the sleeve structure 213 of the first housing 21, with the central position of the second elastic member 25 fixed between the inner structure 234 and the snap structure 235.

Figure 11:
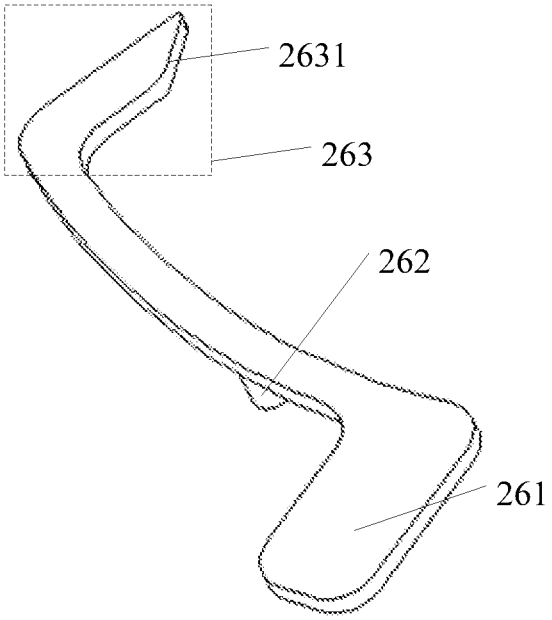
FIG. 11 is a schematic structural diagram of a first button structure according to an embodiment of the present disclosure.

FIG. 11 is a schematic structural diagram of a first button structure according to an embodiment of the present disclosure.

In this embodiment of the present disclosure, the first button structure 26 comprises a button 261, a fulcrum 262, and a limiting portion 263. The fulcrum 262 is located in the assembly structure 212, the button 261 protrudes from the button opening 215, and the limiting portion 263 is located in the first body 211. One end of the fulcrum 262 is connected to the button 261, and the other end of the fulcrum 262 is connected to the limiting portion 263. The limiting portion has a first end 2631.

As shown in FIG. 7, the turntable 232 is provided with a plurality of teeth 2322 along its side. The button 261 is configured to act on the fulcrum 262 to move the limiting portion 263 by the fulcrum 262. The first end 2631 is engaged with the teeth 2322, and thereby rotation of the rotating wheel 23 in the first direction is limited.

It should be noted that this arrangement in which one end of the fulcrum 262 is connected to the button 261, and the other end is connected to the limiting portion 263 is only used to illustrate the specific positional relationship of the fulcrum 262, the button 261 and the limiting portion 263. In practical applications, the first button structure 26 may be an integral structure.

Figure 12:
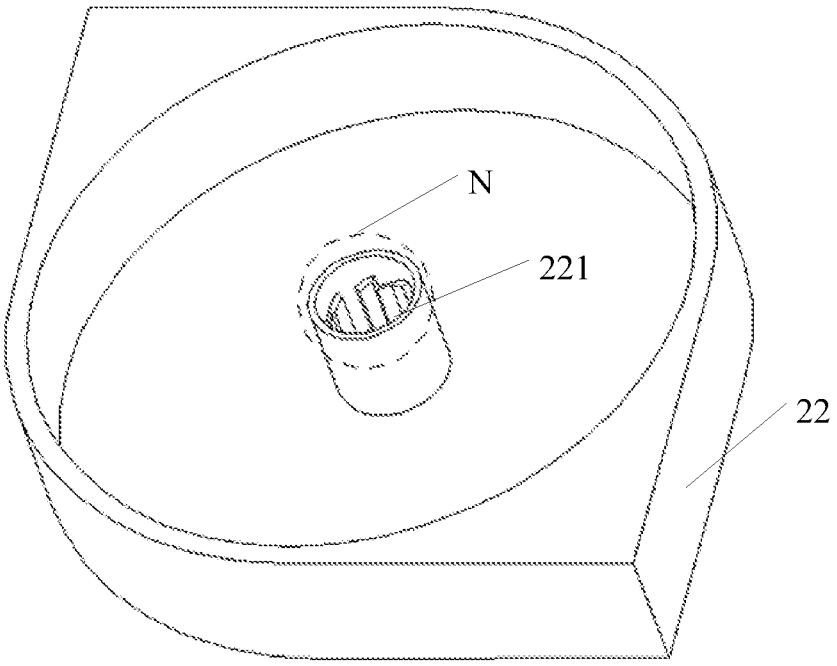
FIG. 12 is a schematic structural view of a second housing according to an embodiment of the present disclosure.
Figure 13:
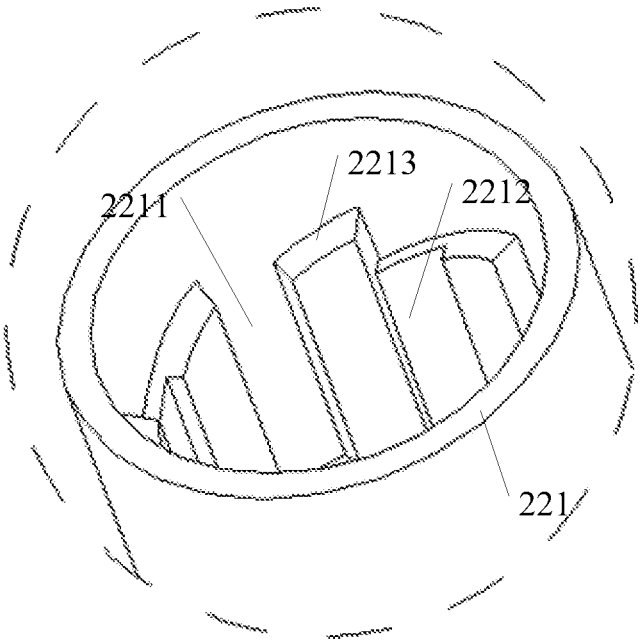
FIG. 13 is a partial enlarged view of region N of the second housing shown in FIG. 12.
Figure 14:
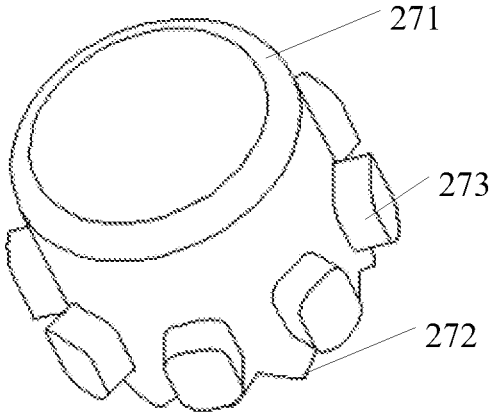
FIG. 14 is a schematic structural diagram of a second button structure according to an embodiment of the present disclosure.

FIG. 12 is a schematic structural view of the second housing according to an embodiment of the present disclosure, FIG. 13 is a partial enlarged view of region N of the second housing shown in FIG. 12, and FIG. 14 is a schematic structural view of the second button structure.

The second housing 22 has a through hole 221; an inner wall of the through hole 221 is provided with a first guiding groove 2211, a second guiding groove 2212 and an inclined portion 2213. The depth of the First guiding groove 2211 is greater than the depth of the second guiding groove 2212.

As shown in FIG. 14, the second button structure 27 comprises a second body 271 and a second top structure 272. The second body 271 has a plurality of second guiding rods 273 on an outer side surface thereof. One end of the second body 271 close to the first top structure 211 is connected to the second top structure 272, and the end surface of the second top structure 272 is beveled.

The first top structure 231 is nested in the second body 271. The second button structure 27 is configured to, in a pressed state, move the second guiding rods 273 on the second body 271 in a third direction along the first guiding groove 2211 and the second guiding groove 2212, push the first top structure 231 to drive the first guiding rods 236 to move in the third direction along the first guiding groove 2211 to compress the first elastic member 24; and when the pressing is canceled, deflect the first guiding rods 236 by the first elastic member 24 in cooperation with the second top structure 272 and the inclined portion 2213, to control the rotating wheel 23 to continue rotating in the second direction.

The first top structure 231 is nested in the second body 271, and the first top structure 231 and the second body 271 together protrude from the through hole 221 of the second housing 22. In this situation, the second guide rods 273 on the second body 271 also enter into the through hole 221. Wherein, the first guiding rod 236 can move up and down along the first guiding groove 2211, while the second guiding rod 273 can move up and down along the first guiding groove 2211 or move up and down along the second guiding groove 2212.

It should be noted that when the entire wiring harness structure 2 is in the vertical state, the third direction refers to the downward direction. For two adjacent second guiding rods 273 on the second body 271, when one of the second guiding rod 273 moves up and down along the first guiding groove 2211, the other second guiding rod 273 moves up and down along the second guiding groove 2212.

In a practical application, the first elastic member 24 is first inserted into the sleeve structure 213 of the first housing 21, with the two ends 252 of the second elastic member 25 fixed in the two limiting slots 214 respectively. Then, the inner structure 234 of the rotating wheel 23 is placed into the sleeve structure 213 of the first housing 21. In this situation, the central position of the second elastic member 25 is fixed between the inner structure 234 and the snap structure 235. Then, the wire 1 is inserted through the first wire inlet C1 of the first housing 21, and is wound between the turntable 232 and the isolating cover 233. The wire 1 is then goes through the slot 2321 on the turntable 232 and is wound between the turntable 232 and the first guiding rods 236, and extends out from the first wire outlet C2 of the first housing 21. Next, the button 261 of the first button structure 26 is protruded from the button opening 215, and the fulcrum 262 is inserted into the assembly structure 212. The first top structure 231 is then nested in the second body 271. The first top structure 231 and the second body 271 protrude from the through hole 221 of the second housing 22. Finally, the first housing 21 is engaged to the second housing 22, and the assembled wiring harness structure 2 is fixed at a suitable position between the device A and the device B for wiring harness.

The working process of the entire wiring harness device will be specifically described below.

When it is required to convert a display mode of a display device, the display device is expanded by an external force. In this case, the wire 1 is stretched and lengthened. First, the wire 1 is forced to stretch the portion of the wire 1 between the second wire inlet D1 and the intermediate wire outlet E1, as well as the elastic member 32, toward the limiting member 31. Before the portion of the wire 1 between the second wire inlet D1 and the intermediate wire outlet E1 is straightened, the limiting member 31 blocks the elastic member 32, so that the interface A1 will not be subjected to an excessive pulling force. At this point, the wire 1 is continually stretched to rotate the rotating wheel 23 in the wiring harness structure 2 in the second direction and compress the second elastic member 25. When the display mode conversion is completed, the wire 1 is no longer stretched. Since the resilience effect of the second elastic member 25 is always exerted on the wire 1, at this point, the second button structure 27 is pressed, the second button structure 27 and the rotating wheel 23 move together in the third direction and compress the first elastic member 24. At this point, the second guiding rod 273 on the second body 271 moves in the third direction along the first guiding groove 2211 and the second guiding groove 2212, pushes the first top structure 231 to move the first guiding rod 236 in the third direction along the first guiding groove 2211. When the first guiding rod 236 of the rotating wheel 23 is pushed out of the first guiding groove 2211, the pressing of the second button structure 27 is canceled. Since the top end P of the first guiding rod 236 is beveled, the end surface of the second top structure 272 is also beveled, and the inclined portion 2213 in the through hole 221 is a structure having a slope, the first guiding rod 236 is deflected by an angle under the action of the resilience of the first elastic member 24 in cooperation with the second top structure 272 and the inclined portion 2213. When the first guiding rod 236 is deflected, the rotating wheel 23 is driven to continue rotating in the second direction.

Figure 15:
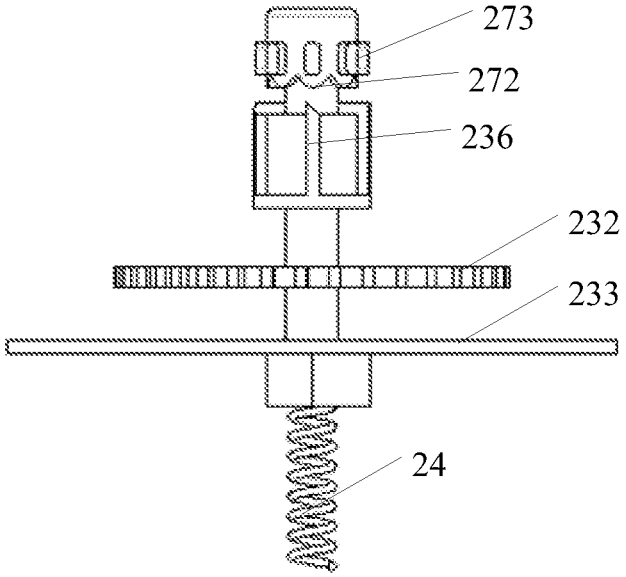
FIG. 15 is schematic structural diagram of the second button structure and the rotating wheel in a first relative position.
Figure 16:
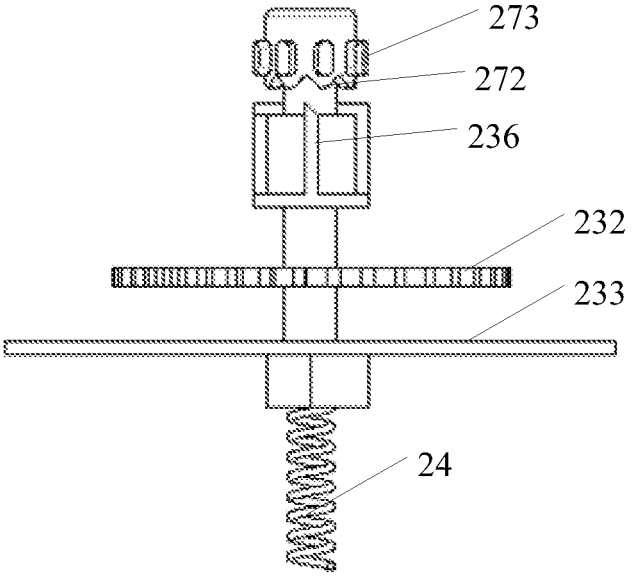
FIG. 16 is schematic structural diagram of the second button structure and the rotating wheel in a second relative position.

As shown in FIGS. 15 and 16, the relative position of the first guiding rod 236 to the second top structure 272 are changed. In FIG. 15, the position of the second top structure 272 corresponds to the position of the first guiding rod 236 when the second button structure 27 is pressed. At this point, the second guiding rod 273 and the first guiding rod 236 both move downward in the first guiding groove 2211. When pressing of the second button structure 27 is cancelled, as shown in FIG. 16, due to the deflection of the first guiding rod 236, the relative position of the first guiding rod 236 to the second top structure 272 is changed. Specifically, when the first guiding rod 236 is pushed out of the first guiding groove 2211, the pressing of the second button structure 27 is canceled. By the resilience of the first elastic member 24, the first guiding rod 236 slides along the second top structure 272, since the inclined portion 2213 has a certain inclination, the first guiding rod 236 slides along the inclined portion 2213 to the end surface of the second guiding groove 2212. Since the second guiding groove 2212 has a smaller depth, the first guiding rod 236 cannot retract upward in the second guiding groove 2212. When the second button structure 27 is pressed again, the first guiding rod 236 is pushed downward, at this point, the position of the first guiding rod 236 corresponds to a next second top structure 272. After the pressing of the second button structure 27 is canceled, the first guiding rod 236 slides along the second top structure 272 correspondingly by the resilience of the first elastic member 24. Meanwhile, the first guiding rod 236 slides along the inclined portion 2213 into a next first guiding groove 2211. Therefore, the first guiding rod 236 is deflected by continuously pressing and releasing the second button structure 27, thereby driving the rotating wheel 23 to continue rotating in the second direction.

It should be noted that when the first guiding rod 236 is deflected by pressing the second button structure 27, the second top structure 272 and the second guiding rod 273 on the second button structure 27 only move up and down without any deflection.

When the rotating wheel 23 is rotated in the second direction to set the wire 1 in the relaxed state, the button 261 of the first button structure 26 is toggled, and the limiting portion 263 is moved by the fulcrum 262, so that the first end 2631 on the limiting portion 263 engages with the teeth 2322 on the turntable 232 to prevent rotation of the rotating wheel 23 in the first direction by the restoring force of the second elastic member 25. At this point, since the wire is in a relaxed state, the elastic member 32 between the second wire inlet D1 and the intermediate, wire outlet E1 also retracts, and eventually the wire 1 in the entire wiring harness device is unstressed.

When it is required to reset the display mode of the display device, that is, when it is required to draw back the wire 1 the button 261 of the first button structure 26 is pressed, and the limiting portion 263 is moved by the fulcrum 262, so that the first end 2631 of the limiting portion 263 is disengaged from the teeth 2322 on the turntable 232, and the rotating wheel 23 is rotated in the first direction by the restoring force of the second elastic member 25, the wire 1 is drawn back and re-wound on the rotating wheel 23. After this process is completed, the wire 1 is also unstressed.

In this embodiment of the present disclosure, a wiring harness device is provided between two interfaces. The wiring harness device includes a wiring harness structure, the wire between the two interfaces passes through the first wire inlet and the first wire outlet of the wiring harness structure. The wire between the two interfaces is drawn back using the wiring harness structure. After the wire is stretched, the wire is controlled to be in a relaxed state. When the display mode of the display device is switched, the length of the wire is adjusted as demanded by the wiring harness device. When the display device is contracted, the wire is drawn back by the wiring harness device, so that the wire between the two interfaces will not be tangled. When the display device is stretched, the wiring harness device provides a wire of a desired length, and after the wire is stretched, the wire is controlled to be in a relaxed state to ensure the service life of the wire.

Figure 17:
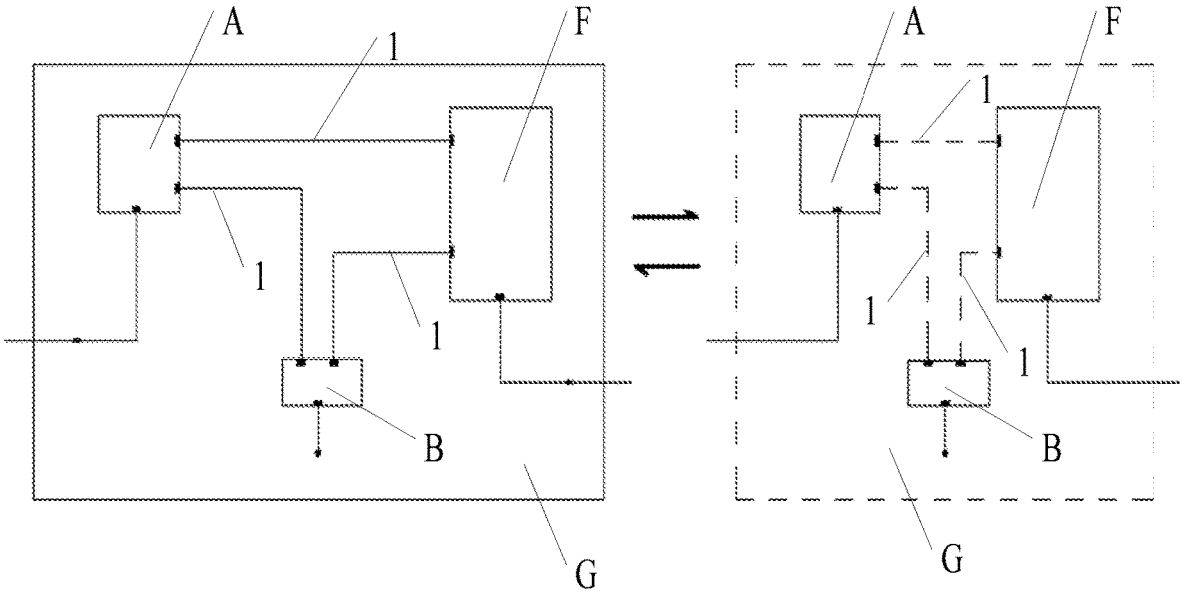
FIG. 17 is a schematic structural diagram of a display device according to an embodiment of the present disclosure.

FIG. 17 is a schematic structural diagram of a display device according to an embodiment of the present disclosure.

An embodiment of the present disclosure also provides a display device including a display component G, a signal board B, a processing board A, a power board F, and the above-described wiring harness device.

For a detailed description of the wiring harness device, reference may be made to the foregoing description of the wiring harness device, which will not be repeated in this embodiment.

The signal board B is connected to the display component G. The processing board A performs system conversion on pictures to be displayed, and the power board F supplies power for the display device. The display component G, the signal board B, the processing board A, and the power board F are all connected with each other using interfaces thereof and wires 1. In a display device with variable display modes, the positions of the signal board B, the processing board A, and the power board F relative to the frame of the display component G are constant, however, the wire between the signal board B and the processing board A, the wire between the processing board A and the power board F, the wire between the signal board B and the power board F, and the frame of the display component G are variable.

Therefore, wiring harness devices are disposed between the signal board B and the processing board A, between the processing board A and the power board F, and between the signal board B and the power board F, and wires 1 are connected between the signal board B and the processing board A, between the processing board A and the power board F, and between the signal board B and the power board F using the wiring harness devices.

In the case where the wiring harness device includes the wiring harness structure 2, when the display mode of the display device changes, for example, when the display device is expanded (switching from the display mode on the right to the display mode on the left in FIG. 17), the wire 1 wound in the wiring harness structure 2 is stretched to provide a wire of a desired length between the signal board B and the processing board A, between the processing board A and the power board F, and between the signal board B and the power board F. After being stretched, the wire 1 is controlled to be in a relaxed state to ensure the service life of the wire. When the display device is contracted (switching from the display mode on the left to the display mode on the right in FIG. 1), the wire is drawn back by the wiring harness device between the signal board B and the processing board A, between the processing board A and the power board F, and between the signal board B and the power board F, so that the wire will not be tangled.

In the case where the wiring harness device includes the wiring harness structure 2 and the interface protection structure 3, when the display mode of the display device changes, for example, when the display device is expanded (switching from the display mode on the right to the display mode on the left in FIG. 17), the wire 1 is unstressed during the process of expanding the display device and after the expansion of the display device, the interface of the wire is unstressed and will not detached from the interfaces of the signal board B, the processing board A or the power board F. When the display device is contracted (switching from the display mode on the left to the display mode on the right in FIG. 17), the wire is drawn back by the wiring harness device between the signal board B and the processing board A, between the processing board A and the power board F, or between the signal board B and the power board F, so that the wire will not be tangled.

In this embodiment of the present disclosure, the display device includes a display component, a signal board, a processing board, a power board, and a wiring harness device. A wiring harness device is provided between two interfaces. The wiring harness device includes a wiring harness structure. A wire between the two interfaces passes through the first wire inlet and the first wire outlet of the wiring harness structure. The wire between the two interfaces can be drawn back by the wiring harness structure. After the wire is stretched, the wire is controlled to be in a relaxed state. When the display mode of the display device is switched, the length of the wire is adjusted as demanded by the wiring harness device. When the display device is contracted, the wire is drawn back by the wiring harness device, so that the wire between the two interfaces will not be tangled. When the display device is stretched, the wiring harness device provides a wire of a desired length, and after the wire is stretched, the wire is controlled to be in a relaxed state to ensure the service life of the wire.

Each embodiment in this description is described in a progressive manner and focuses on differences from other embodiments. For the same or similar parts of the various embodiment, reference can be made to each other.

Note that, in this description, the use of relational terms, if any, such as first and second and the like are used solely to distinguish one from another entity or action without necessarily requiring or implying any actual such relationship or order between such entities or actions. Further, terms "include", "comprise" or their any other variations are intended to encompass non-exclusive composition, so that a process, method, product or device comprising a series of factors may comprise not only these factors, but also other factors that are not listed explicitly, or factors intrinsic to this process, method, product or device. Without limitation, a factor defined by wording "comprise one . . . " does not exclude the existence of other same factors in a process, method, product or device comprising such factor.

The above is a detailed description of the wiring harness device and display device provided in the present disclosure. Specific examples are applied to elaborate the principles and embodiments of the present disclosure, and the aforementioned descriptions of the embodiments are only used to assist in understanding the method of the present disclosure and its core ideas. For those of ordinary skill in the art, according to the concept of the present disclosure, variations can be made to the embodiments and application scope of the present disclosure. To sum up, the contents of the present disclosure cannot be understood as limitations to the present disclosure.

What is claimed is:

1. A wiring harness device applied to a wire connected between two interfaces, comprising:

a wiring harness structure having a first wire inlet and a first wire outlet, the wire entering the wiring harness structure through the first wire inlet and exiting the wiring harness structure through the first wire outlet, the wiring harness structure configured to store and provide the wire, and control the wire to be in a relaxed state after stretching the wire between the two interfaces, the relaxed state corresponding to an absence of tension in the wire, wherein the wiring harness device further comprises:

an interface protection structure disposed between at least one of the two interfaces and the wiring harness structure, wherein the interface protection structure has a second wire inlet and a second wire outlet, the wire entering the interface protection structure through the second wire inlet and exiting the interface protection structure through the second wire outlet, the interface protection structure is configured to limit a stretched length of the wire between the second wire inlet and the second wire outlet, the interface protection structure comprises:

an elastic member having the second wire inlet and an intermediate wire outlet that allow the wire to pass through, wherein the wire is fixedly connected to the elastic member at the positions of the second wire inlet and the intermediate wire outlet, the wire between the second wire inlet and the intermediate wire outlet is in a bent state when the elastic member is in a natural state, and when the elastic member is in a maximum tension state, the wire between the second wire inlet and the intermediate wire outlet is in a straight state; and a limiting member having an intermediate wire inlet and the second wire outlet that allow the wire to pass through, and configured to limit a stretched length of the elastic member.

2. A display device, comprising the wiring harness device of claim 1.

3. The wiring harness device according to claim 1, wherein the wire within the wiring harness device and the wire outside the wiring harness device are both in the relaxed state.

4. A wiring harness device applied to a wire connected between two interfaces, comprising:

a wiring harness structure having a first wire inlet and a first wire outlet, the wire entering the wiring harness structure through the first wire inlet and exiting the wiring harness structure through the first wire outlet, the wiring harness structure configured to store and provide the wire, and control the wire to be in a relaxed state after stretching the wire between the two interfaces, the relaxed state corresponding to an absence of tension in the wire, wherein the wiring harness structure comprises: a first housing, a second housing, a rotating wheel, a first elastic member, a second elastic member, a first button structure, and a second button structure; wherein, the first housing has the first wire inlet and the first wire outlet; the wire is wound on the rotating wheel;

the first button structure is disposed on the first housing and configured to control rotation of the rotating wheel in a first direction;

the second button structure is disposed on the second housing and connected to the rotating wheel, configured to control rotation of the rotating wheel in a second direction, wherein the second direction is opposite to the first direction;

the rotating wheel is disposed between the first housing and the second housing, and is coupled to the second elastic member at a side close to the bottom of the first housing; the rotating wheel is configured to rotate in a second direction when the wire is stretched such that the second elastic member is in a compressed state, and after the stretch of the wire, the rotating wheel continues to rotate in the second direction by an angle under the control of the second button structure and is fixed by the first button structure so that the wire is in a relaxed state; when the wire is stored, the fixing of the rotating wheel is canceled by the first button structure so that the rotating wheel rotates in the first direction by the restoring force of the second elastic member to store the wire, wherein the rotating wheel comprises a first top structure, a turntable, an isolating cover, an inner structure, and a snap structure;

the first top structure is coupled to the second button structure; the first top structure has a plurality of first guiding rods on an outer side surface of the first top structure;

a slot is provided on the turntable in its radial direction, the wire being wound between the turntable and the isolating cover, and between the turntable and the first guiding rods through the slot respectively;

the inner structure and the snap structure are both located on a side of the isolating cover facing away from the turntable, and a central position of the second elastic member is fixed between the inner structure and the snap structure.

5. The wiring harness device according to claim 4, wherein the first housing comprises a first body, an assembly structure, a sleeve structure, and two limiting slots;

the sleeve structure and the two limiting slots are fixed on the bottom of the first body, the first elastic member and the inner structure are both disposed in the sleeve structure, and the second elastic member is fixed between the two limiting slots;

the first body has the first wire inlet, the first wire outlet, and a button opening for mounting the first button structure, the first button structure being assembled in the assembly structure and protruding from the button opening.

6. The wiring harness device according to claim 5, wherein the first wire inlet and the first wire outlet are disposed at different depths of the first body.

7. The wiring harness device according to claim 5, wherein the second elastic member is a coil spring, and two ends of the coil spring are fixed in the two limiting slots respectively.

8. The wiring harness device according to claim 5, wherein the first button structure comprises a button, a fulcrum, and a limiting portion;

the fulcrum is located in the assembly structure, the button protrudes from the button opening, and the limiting portion is located in the first body, wherein one end of the fulcrum is connected to the button, and the other end of the fulcrum is connected to the limiting portion, the limiting portion has a first end; the turntable is provided with a plurality of teeth;

the button is configured to act on the fulcrum to move the limiting portion, so that the first end is engaged with the teeth to limit rotation of the rotating wheel in the first direction.

9. The wiring harness device according to claim 4, wherein the second housing has a through hole; an inner wall of the through hole is provided with a first guiding groove, a second guiding groove and an inclined portion, the depth of the first guiding groove is greater than the depth of the second guiding groove;

the second button structure comprises a second body and a second top structure, wherein the second body has a plurality of second guiding rods on an outer side surface of the second body, an end of the second body close to the first top structure is connected to the second top structure, and an end surface of the second top structure is beveled;

the first top structure is nested within the second body;

the second button structure is configured to, when in a pressed state, move the second guiding rod on the second body in a third direction along the first guiding slot and the second guiding slot, push the first top structure to drive the first guiding rod to move in the third direction along the first guiding groove to compress the first elastic member; and when the pressing is canceled, deflect the first guiding rod by the first elastic member in cooperation with the second top structure and the inclined portion, to control the rotating wheel to continue rotating in the second direction.

10. The wiring harness device according to claim 4, wherein the first elastic member is a spring.

11. A display device, comprising the wiring harness device of claim 4.

* * * * *